US005147969A

United States Patent [19]

Hiyoshi et al.

[11] Patent Number: 5,147,969

[45] Date of Patent: Sep. 15, 1992

[54] MUSICAL TONE CONTROL APPARATUS

[75] Inventors: Teruo Hiyoshi; Akira Nakada; Hideo Suzuki; Mamoru Kinpara; Kunihiko Watanabe, all of Hamamatsu, Japan

[73] Assignee: Yamaha Corporation, Hamamatsu, Japan

[21] Appl. No.: 694,126

[22] Filed: May 1, 1991

Related U.S. Application Data

[60] Division of Ser. No. 532,020, May 29, 1990, which is a continuation of Ser. No. 114,611, Oct. 29, 1987, abandoned.

[30] Foreign Application Priority Data

| | | | |
|---|---|---|---|
| Oct. 31, 1986 | [JP] | Japan | 61-259806 |
| Nov. 12, 1986 | [JP] | Japan | 61-269385 |
| Nov. 20, 1986 | [JP] | Japan | 61-277059 |

[51] Int. Cl.[5] ..... G10H 1/00

[52] U.S. Cl. ..... 84/600; 84/734; 84/735; 84/742; 84/744; 84/DIG. 7

[58] Field of Search ..... 84/735, 737-738, 84/723, 742, 743, DIG. 7, 600, 734, 744

[56] References Cited

U.S. PATENT DOCUMENTS

| | | | |
|---|---|---|---|
| 4,043,241 | 8/1977 | Lui | 84/718 |
| 4,627,324 | 12/1986 | Zwosta | 84/694 |
| 4,777,856 | 10/1988 | Lui et al. | 84/DIG. 7 |
| 4,860,364 | 8/1989 | Giannini | 84/DIG. 7 |
| 4,905,560 | 3/1990 | Suzuki et al. | 84/600 |
| 4,920,848 | 5/1990 | Suzuki | 84/600 |
| 4,977,811 | 12/1990 | Suzuki | 84/600 |
| 5,005,460 | 4/1991 | Suzuki et al. | 84/600 |
| 5,022,303 | 6/1991 | Suzuki et al. | 84/600 |
| 5,029,508 | 7/1991 | Suzuki et al. | 84/742 X |
| 5,046,394 | 9/1991 | Suzuki et al. | 84/600 |

FOREIGN PATENT DOCUMENTS 3422737 12/1984 Fed. Rep. of Germany .

*Primary Examiner*—A. T. Grimley
*Assistant Examiner*—Matthew S. Smith
*Attorney, Agent, or Firm*—Graham & James

[57] ABSTRACT

The musical tone control apparatus detects a movement of a player, such as a holding, touching, beating, depressing, pulling, lifting up or down movement. Then, the musical tone control apparatus generates musical tone control data based on a detecting result of the movement of the player. The musical tone control data control a tone pitch, a tone color or a tone volume of a musical tone to be generated.

3 Claims, 7 Drawing Sheets

MUSICAL TONE CONTROL APPARATUS

This is a division of application Ser. No. 07/532,020, filed on May 29, 1990, which is a continuation of application Ser. No. 07/114,611, filed on Oct. 29, 1987, now abandoned.

BACKGROUND OF THE INVENTION

1. Field of the Invention

The present invention generally relates to musical tone control apparatuses, and more particularly to a musical tone control apparatus which controls a musical tone signal based on a movement of a player such as a movement of a holding, a touching, a beating (or clapping hands), a depressing, a pulling, or a lifting up or down.

2. Prior Art

Conventionally, a musical tone is generated by playing the piano, the violin, the bass drum and the like. Or, the musical tone is accompanied with a voice generated from the vocal chords of the player who sings. Meanwhile, the conventional musical tone control apparatus controls tone characteristics, such as a tone color, a tone pitch and a tone volume of the musical tone in response to the playing of an electronic musical instrument, for example. However, such conventional musical tone control apparatus cannot control the musical tone in response to the movement of the player's body or his portion.

SUMMARY OF THE INVENTION

It is therefore a primary object of the present invention to provide a musical tone control apparatus which controls the musical tone signal in response to the movement of the player's body or his portion.

In a first aspect of the invention, there is provided a musical tone control apparatus comprising: (a) detecting means for detecting a holding movement of a player's hand; and (b) means for generating musical tone control data based on a detecting result of the detecting means, the musical tone control data controlling a musical tone signal.

In a second aspect of the invention, there is provided a musical tone control apparatus comprising; (a) detecting means for detecting positions of player's fingers; and (b) means for generating musical tone control data based on a detecting result of the detecting means, the musical tone control data controlling a musical tone signal.

In a third aspect of the invention, there is provided a musical tone control apparatus comprising: (a) detecting means for detecting pressures given by fingers of a player who holds; and (b) generating means for generating musical tone control data based on a detecting result of the detecting means, the musical tone control data controlling a musical tone signal.

In a fourth aspect of the invention, there is provided a musical tone control apparatus comprising: (a) detecting means for detecting position relations between a thumb and each of other fingers of a player; and (b) mean for generating musical tone control data based on a detecting result of the detecting means, the musical tone control data controlling a musical tone signal.

In a fifth aspect of the invention, there is provided a musical tone control apparatus comprising: (a) detecting means for detecting a touching movement or a beating movement of a player; and (b) means for generating musical tone control data based on a detecting result of the detecting means, the musical tone control data controlling a musical tone signal.

In a sixth aspect of the invention. there is provided a musical tone control apparatus comprising: (a) detecting means for detecting position on a player to which a certain pressure is given by his touching or beating movement; and (b) means for generating musical tone control data based on a detecting result of the detecting means, the musical tone control data controlling a musical tone signal.

In a seventh aspect of the invention, there is provided a musical tone control apparatus comprising: (a) detecting means for detecting a value of a pressure given to a certain portion of a player by his touching or beating movement; and (b) means for generating musical tone control data based on a detecting result of the detecting means, the musical tone control data controlling a musical tone signal.

In an eighth aspect of the invention, there is provided a musical tone control apparatus comprising: (a) detecting means for detecting a vibrational tone generated from a player by his touching or beating movement; and (b) means for generating musical tone control data based on a detecting result of the detecting means, the musical tone control data controlling a musical tone signal.

In a ninth aspect of the invention, there is provided a musical tone generating apparatus comprising: (a) detecting means for detecting a depressing, pulling, lifting up or down movement of a player or an animal; and (b) means for generating musical tone control data based on a detecting result of the detecting means, the musical tone control data controlling a musical tone signal.

In a tenth aspect of the invention, there is provided a musical tone generating apparatus comprising: (a) detecting means for detecting a position or a variation of a predetermined portion of a player or an animal; and (b) means for generating musical tone control data based on a detecting result of the detecting means, the musical tone control data controlling a musical tone signal.

BRIEF DESCRIPTION OF THE DRAWINGS

Further objects and advantages of the present invention will be apparent from the following description, reference being had to the accompanying drawings wherein preferred embodiments of the present invention are clearly shown.

In the drawings.

DESCRIPTION OF THE PREFERRED EMBODIMENTS

Figure 1:
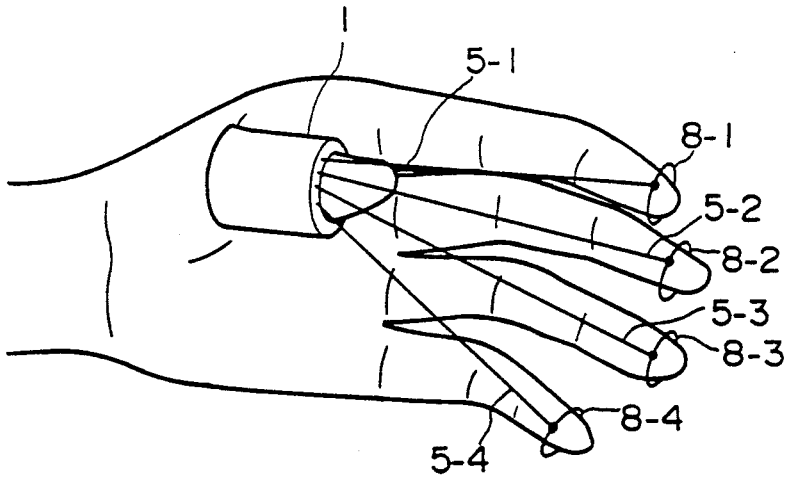
FIG. 1 shows an appearance of a detector used in a first embodiment of the present invention.

Referring now to the drawings, wherein like reference characters designate like or corresponding parts throughout the several views. Next, description will be given with respect to each of preferred embodiments according to the present invention in order.

[A] FIRST EMBODIMENT

Figure 2:
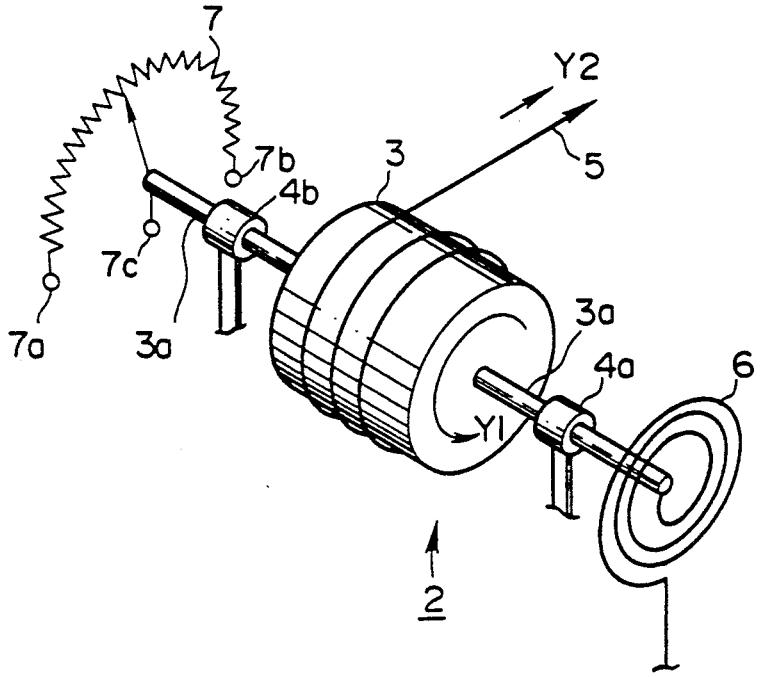
FIG. 2 is a perspective view showing an embodiment of a voltage generator of the first embodiment.

FIG. 1 shows an appearance of a detector mounted on a player's hand. This detector is used in a first embodiment of the musical tone control apparatus according to the present invention. In FIG. 1, a holder 1 made of synthetic resin is put on a player's thumb. The holder 1 provides four voltage generators 2-1 to 2-4 (shown in FIG. 3) each represented by a voltage generator 2 shown in FIG. 2. In FIG. 2, a roller shaft 3*a* is inserted through a center of a roller 3 and also inserted through a bearing 4*a* so that the roller 3 can be revolved in accordance with a revolving of the roller shaft 3*a*. In addition, a string 5 is wound on to an outer peripheral surface of the roller 3. Further, one edge portion of a spiral spring 6 is fixed (not shown) and other edge portion thereof is fixed at one edge portion of the roller shaft 3*a*. Such spiral spring 6 forces the roller 3 to move in a direction Y1 so that the spring 5 is prevented from being loosened. Furthermore, the other edge portion of the roller shaft 3*a* is inserted through a bearing 4*b* and attached to a shaft of a volume 7. This volume 7 has a slider terminal 7*c* and terminals 7*a* and 7*b*. The terminal 7*a* is grounded, and a positive constant voltage is applied to the terminal 7*b*. When the shaft of the volume 7 is revolved in a clockwise direction, a voltage applied to the slider terminal 7*c* is gradually increased. Therefore, the voltage outputted from the slider terminal 7*c* is increasing while the string 5 is pulled in a direction Y2 against an elastic resiliency of the spiral spring 6.

The four above-constructed voltage generators 2-1 to 2-4 are provided in the holder 1, and the string 5 is drawn out from each voltage generator 2. As shown in FIG. 1, four tip ends of the strings 5 are tied to respective rings 8-1 to 8-4 which are put on an index finger, a middle finger, a third finger and a little finger of the player's hand. In such construction of the detector, an output voltage level of each voltage generator 2 becomes large when the player stretches his finger. To the contrary, the output voltage level of each voltage generator 2 becomes smaller when the player bends his finger. The output voltages of the voltage generators 2-1 to 2-4 are supplied to respective input terminals (1 to 4) of a multiplexer 9 shown in FIG. 3. This multiplexer 9 selects one output voltage from the output voltages of the voltage generators 2-1 to 2-4 based on select data SD supplied to an select terminal SEL thereof, and the selected output voltage is supplied to an analog-to-digital (A/D) converter 10 wherein the selected output voltage is converted into data SO. The data SO are supplied to a processing circuit 11 which is constituted by a central processing unit (CPU) and the like.

First, the processing circuit 11 sets the value of the select data SD for the multiplexer 9 to "1" so as to select the voltage generator 2-1 corresponding to the index finger of the player. Hence, the output voltage of the voltage generator 2-1 is supplied to the A/D converter 10 via the multiplexer 9, and such output voltage is converted into the digital data SO. Such digital data SO are supplied to the processing circuit 11, and the processing circuit 11 checks whether the value of such digital data SO is larger than a predetermined value or not. When the value of such digital data SO is larger than the predetermined value, the processing circuit 11 outputs the digital data SO as musical tone control data CD and also outputs the select data SD (having the value "1") as a key code KC. These musical tone control data CD and key code KC are supplied to a musical tone signal generating circuit 12.

Next, the processing circuit 11 sets the value of the select data SD to "2". Thus, the output voltage of the voltage generator 2-2 corresponding to the middle finger of the player is converted into the data SO by the A/D converter 10, and such data SO are supplied to the processing circuit 11. Similar to the above-mentioned operation for the voltage generator 2-2 of the player's index finger, the processing circuit 11 checks whether the value of such data SO is larger than the predetermined value or not. When the value of such data SO is larger than the predetermined value, the processing circuit 11 outputs such data SO as the musical tone control data CD and also outputs the select data SD as the key code KC. These data SO and key code KC are supplied to the musical tone signal generating circuit 12.

Similar to the above-mentioned operations for the voltage generators 2-1 and 2-2 for the player's index finger and middle finger, the processing circuit 11 sequentially sets the value of the select data SD to "3", "4", "1", "2", . . . In other words, the value of the select data SD is sequentially set to "1", "2", "3" and "4" repeatedly. Such select data SD are supplied to the multiplexer 9. At each time when the processing circuit 11 varies the value of the select data SD, the processing circuit 11 checks the value of the data SO so as to output the musical tone control data CD and the key code KC to the musical tone signal generating circuit 12. Thus, the musical tone signal generating circuit 12 generates a musical tone signal having a tone pitch corresponding to the key code KC, and the level of such musical tone signal is controlled by the musical tone control data CD. Such musical tone signal is supplied to a speaker 13. For example, when the value of the key code KC equals to "1", the musical tone signal designates a tone pitch of "do". Similarly, when the value of the key code KC equals to "2", "3" or "4", the musical tone signal designates a tone pitch of "re", "mi" or "so". In addition, the level of such musical tone signal is controlled by the musical tone control data CD, and such level-controlled musical tone signal is supplied to the speaker 13.

According to the above-mentioned constitution of the first embodiment, when the player bends his index finger by a predetermined angle or more, the speaker 13 generates a musical tone having a tone pitch "do" corresponding to the bending angle of the player's index finger. In addition, when the player bends his middle finger by the predetermined angle or more, the speaker 13 generates a musical tone having a tone pitch "re" corresponding to the bending angle of the player's middle finger. Similarly, when the player bends his third finger or his little finger, the speaker 13 generates a musical tone having a tone pitch "mi" or "so" corresponding to the bending angle of the player's third or little finger.

[B] SECOND EMBODIMENT

Figure 3:
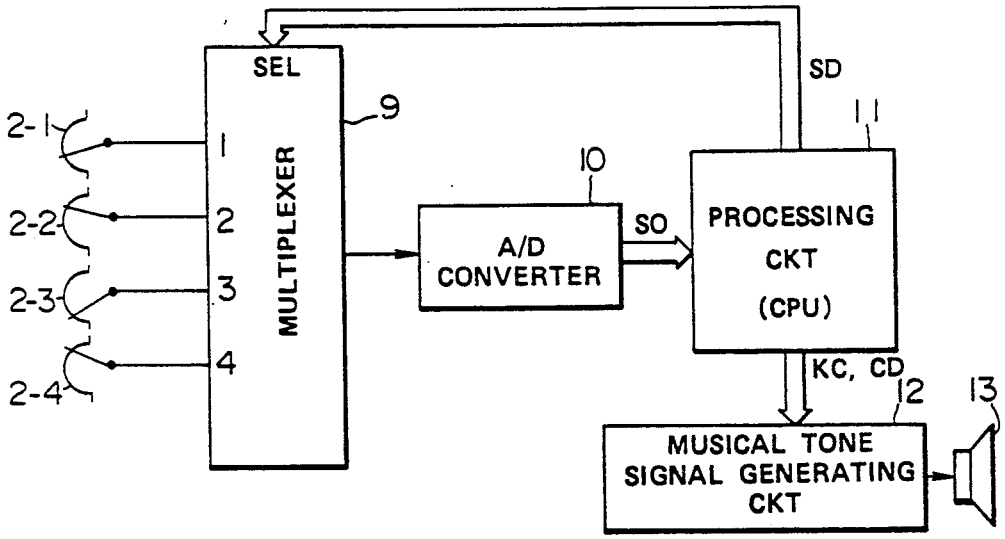
FIG. 3 is a circuit diagram showing a musical tone generating system employing the musical tone control apparatus according to the first embodiment.
Figure 4:
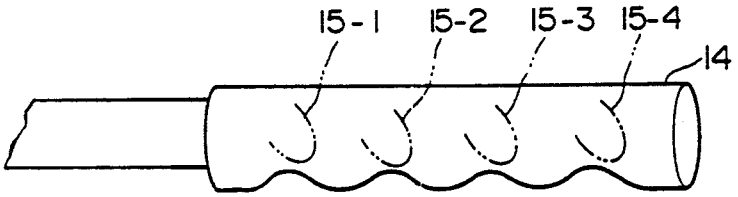
FIG. 4 shows an appearance of a detector used in a second embodiment of the present invention.
Figure 5:
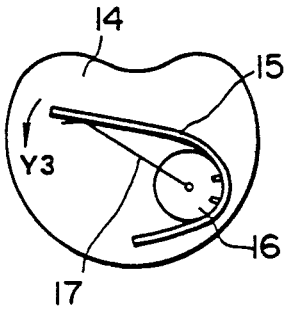
FIG. 5 is a sectional view of the detector shown in FIG. 4.

Next, description will be given with respect to a second embodiment of the present invention in conjunction with FIGS. 4 and 5. FIG. 4 shows a stick-type detector according to the second embodiment, and 14 designates a rubber grip. Within the grip 14, U-shaped plate springs 15-1 to 15-4 are respectively provided at positions corresponding to respective fingers of the player. At inner peripheral surfaces of the plate springs 15-1 to 15-4 (represented by a plate spring 15 shown in FIG. 5), variable resistors 16-1 to 16-4 (represented by a variable resistor 16 shown in FIG. 5) are arranged respectively. One edges of hard wires 17-1 to 17-4 (represented by a hard wire 17) are mounted on respective shafts of the variable resistors 16-1 to 16-4, and other edges of the hard wires 17-1 to 17-4 touch at certain portions of the plate springs 15-1 to 15-4. Instead of the voltage generators 2-1 to 2-4 of the first embodiment, voltages obtained at respective slide terminals (not shown) of the variable resistors 16-1 to 16-4 are supplied to the multiplexer 9 shown in FIG. 3. The electric constitution of the second embodiment is identical to that of the first embodiment as shown in FIG. 3, hence, detailed description thereof will be omitted.

In the above-mentioned second embodiment, when the player holds the grip 14 and strongly depresses the plate spring 15-1 by his index finger, the plate spring 15-1 is bent in a direction Y3 so that the shaft of the variable resistor 16-1 is revolved and the output level of the variable resistor 16-1 becomes larger. Similar to a musical tone generating process of the first embodiment, the speaker 13 generates the musical tone having the tone pitch "do" when the output level of the variable resistor 16-1 exceeds over a predetermined level. Similarly, the speaker 13 generates the musical tone having the tone pitch "re", "mi" or "so" when the player strongly depresses the plate spring 15-2, 15-3 or 15-4 by his middle finger, his third finger or his little finger.

As described heretofore, both of the first and second embodiments control a generation of the musical tone based on the holding movement of the player. More specifically, the first embodiment detects position relations between the thumb versus the index finger, the middle finger, the third finger and the little finger, hence, the first embodiment controls the musical tone based on the detecting result thereof. On the contrary, the second embodiment controls the musical tone based on the detected holding pressures of respective fingers.

Incidentally, it is possible to control the tone pitch or the tone color of the musical tone based on the musical tone control data which correspond to the output voltages of the voltage generators 2-1 to 2-4 or the output voltages of the variable resistors 16-1 to 16-4. For example, it is possible to generate the musical tone of the bass drum or a drum when the player strongly bends his index finger. In addition, it is possible to generate the musical tone of the cymbal or a triangle when the player weakly bends his index finger.

[C] THIRD EMBODIMENT

Figure 6:
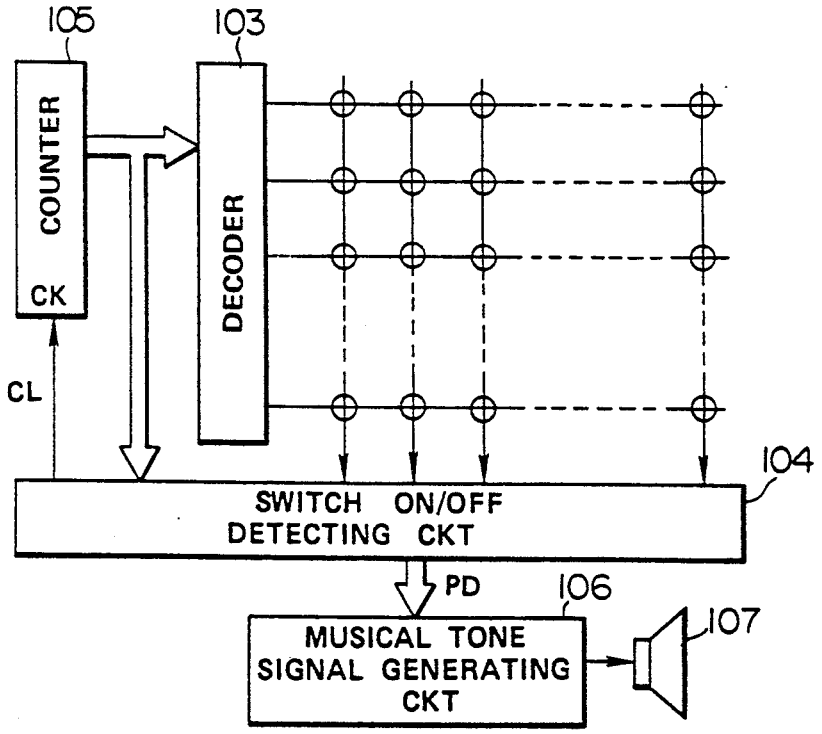
FIG. 6 is a block diagram showing a musical tone generating system employing the musical tone control apparatus according to a third embodiment.

Next, description will be given with respect to a third embodiment of the musical tone control apparatus according to the present invention in conjunction with FIGS. 6 and 7.

Figure 7:
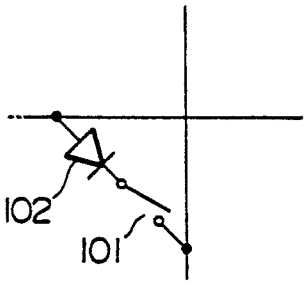
FIG. 7 shows a main part of the third embodiment shown in FIG. 6.

In FIG. 7, 101 represents one of touch switches which are mounted at several portions of a player's body, and each touch switch 101 is connected to a diode 102. Such touch switches 101 form a matrix as shown in FIG. 6 (i.e., each circle in FIG. 6 represents the touch switch 101 connected with the diode 102 as shown in FIG. 7). Row lines of the matrix are connected to a decoder 103, and column lines of the matrix are connected to a switch on/off detecting circuit 104. The decoder 103 decodes a count value of a counter 105, and such count value represents each of (N+1) row lines (where N denotes an integral number). The counter 105 varies the count value thereof from 0-row line to N-row line so as to set levels of 0-row line to N-row line at high (H) levels in order. In addition, the switch on/off detecting circuit 104 outputs a clock pulse CL having a constant cycle to a clock input terminal CK of the counter 105. Thus, the counter 105 outputs data the value of which varies from "0" to "N" repeatedly, whereby each of the 0-row line to N-row line is sequentially and repeatedly scanned. Therefore, when the decoder 103 sets a level of a certain row line to the high level and one touch switch 101 corresponding to the certain row line is turned on, a signal having the high level is outputted to a certain column line corresponding to the touch switch 101 which is turned on. The switch on/off detecting circuit 104 checks the count value of the counter 105 and the signal level of each column line of the matrix so as to detect a position of the touch switch 101 which is turned on. In other words, the switch on/off detecting circuit 104 detects the position such as a row number and a column number on the matrix. Thus, the switch on/off detecting circuit 104 outputs position data PD (representative of the detected position of the touch switch 101 which is turned on) to a musical tone signal generating circuit 106 as the musical tone control data.

The musical tone signal generating circuit 106 generates a musical tone signal having a tone pitch corresponding to the position data PD outputted from the switch on/off detecting circuit 104 and outputs such musical tone signal to a speaker 107.

According to the above-constituted third embodiment, it is possible to turn on one of the touch switches 101 which are mounted at several portions of the player's body in response to a "touching" movement or a "beating" movement of the player. More specifically, an external object is "touched" or "beaten" by use of a certain player's portion provided with the touch switch 101, or the player "touches" or "beats" the certain player's portion provided with the touch switch 101 by himself. Hence, a certain pressure is given to the touch switch 101 so that the touch switch 101 is selectively turned on. Thus, the musical tone generating circuit 106 generates and outputs the musical tone signal to the speaker 107 in response to the matrix position of the touch switch 101 which is turned on. Accordingly, the speaker 107 generates a musical tone having a tone pitch depending on the certain player's portion to which a certain pressure is given by the "touching" or "beating" movement of the player.

Incidentally, it is possible to constitute the third embodiment such that a tone volume or a tone color is varied based on the position data PD outputted from the switch on/off detecting circuit 104. In addition, it is also possible to constitute the third embodiment such that a performance speed of an automatic rhythm tone is varied based on the position data PD. In this case, it is possible to generate a musical tone having the tone volume or the tone color in response to the certain player's portion to which the certain pressure is given by the "touching" or "beating" movement of the player.

[D] FOURTH EMBODIMENT

Figure 8:
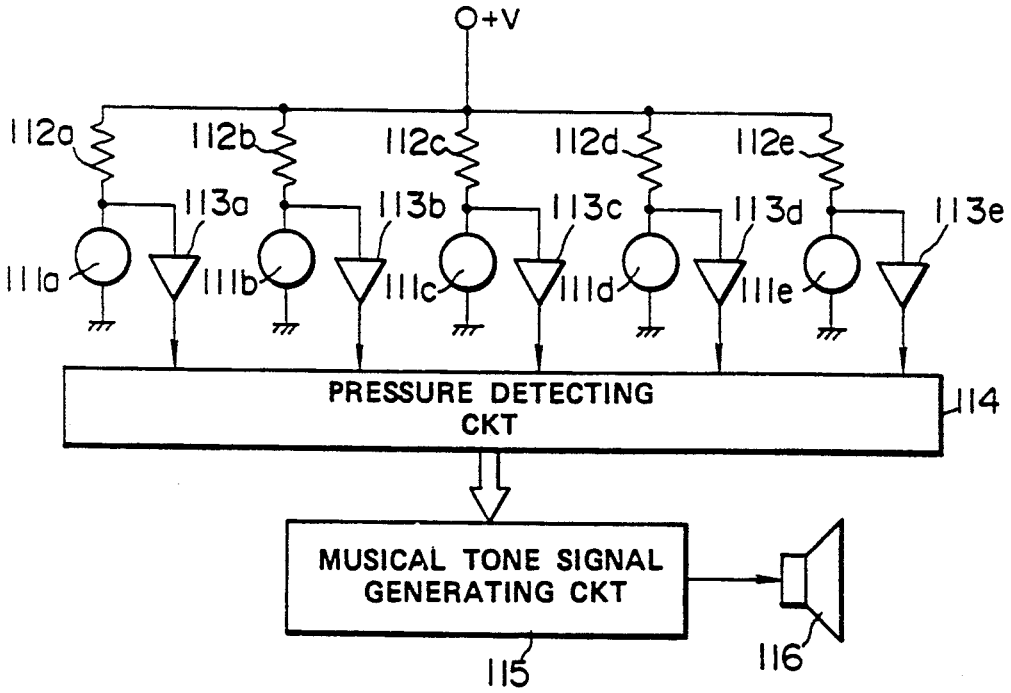
FIG. 8 is a block diagram showing a musical tone generating system employing the musical tone control apparatus according to a fourth embodiment.
Figure 9:
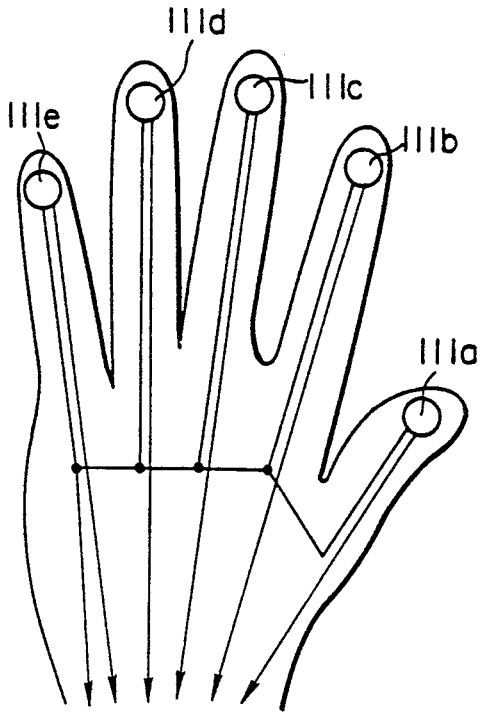
FIG. 9 shows an appearance of the player's hand mounted with conductive rubber portions shown in FIG. 8.

Next, description will be given with respect to a fourth embodiment in conjunction with FIGS. 8 and 9.

In this fourth embodiment, each of conductive rubber portions 111*a* to 111*e* is mounted at each finger of the player. As shown in FIG. 8, these conductive rubber portions 111*a* to 111*e* are connected to a power source (not shown) for supplying a voltage of "+V" via respective resistors 112*a* to 112*e* in parallel. Voltages supplied to amplifiers 113*a* to 113*e* are varied in response to resistance variations of the conductive rubber portions 111*a* to 111*e*, and such voltages are amplified in the amplifiers 113*a* to 113*e* wherein the amplified voltages are supplied to a pressure detecting circuit 114. This pressure detecting circuit 114 normally checks output levels of the amplifiers 113*a* to 113*e*. More specifically, this pressure detecting circuit 114 outputs a discrimination signal for discriminating a certain amplifier the output level of which becomes smaller than a predetermined level from the amplifiers 113*a* to 113*e* and also outputs a pressure detection signal (consists of an analog signal or a digital signal) corresponding to the output level of the certain amplifier. These discrimination signal and pressure detection signal are supplied to a musical tone signal generating circuit 115 as the musical tone control data. Hence, the musical tone signal generating circuit 115 generates a musical tone signal having a tone pitch corresponding to the discrimination signal, and the level of such musical tone signal is controlled by the pressure detection signal. Therefore, a speaker 116 generates a musical tone based on the musical tone signal supplied from the musical tone signal generating circuit 115.

In the above-constructed fourth embodiment, the speaker 116 can generate the musical tones having tone pitches each corresponding to each of the conductive rubber portions 111*a* to 111*e* which is applied with the pressure, and the tone volume of such musical tone depends on the value of the applied pressure.

Incidentally, it is possible to constitute the fourth embodiment such that the tone pitch or the tone color (or the tone color or the tone volume) of the musical tone is varied depending on the pressure detection signal (or the discrimination signal). In addition, it is also possible to constitute the fourth embodiment such that the performance speed of the automatic rhythm tone is varied depending on the pressure detection signal (or the discrimination signal). In such case, the fourth embodiment can generate the musical tone having the tone pitch or the tone color in response to the value of the pressure applied to the certain player's portion by the "touching" or "beating" movement of the player.

[E] FIFTH EMBODIMENT

Figure 10:
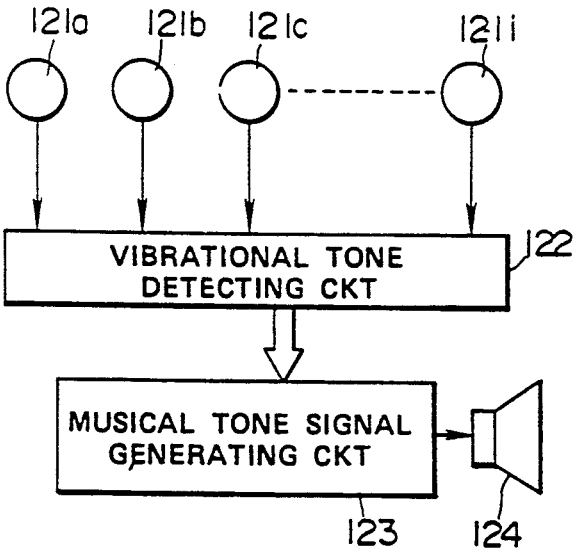
FIG. 10 is a block diagram showing a musical tone generating system employing the musical tone control apparatus according to a fifth embodiment.
Figure 11:
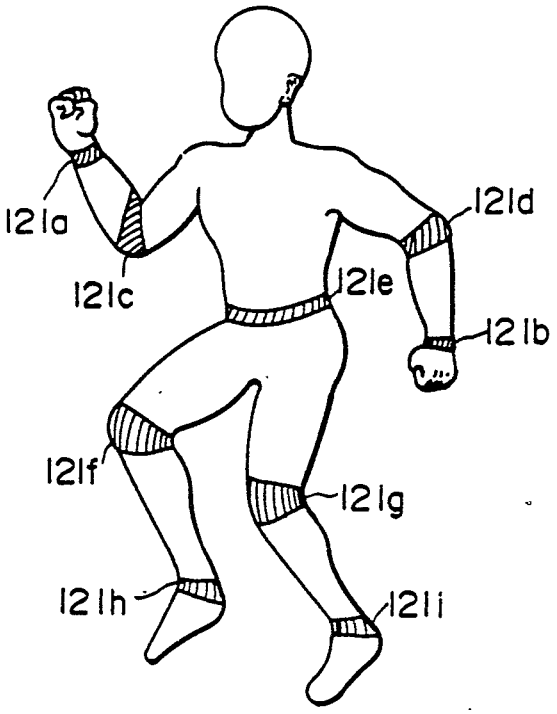
FIG. 11 shows the player who is mounted by bone conduction microphones shown in FIG. 10 at his several portions.

Next, description will be given with respect to a fifth embodiment in conjunction with FIGS. 10 and 11.

The fifth embodiment is characterized by using bone conduction microphones 121*a* to 121*i* which are mounted at predetermined parts of the player. These bone conduction microphones 121*a* to 121*i* use the piezoelectric elements as pick-up sensors thereof each of which picks up a vibrational tone of bones which are arranged in the vicinity of the player's skin surface. By use of the belt and rubber bands, these bone conduction microphones 121*a* to 121*i* can be mounted at the waist, the hands, the neck, the ankles, the knees, the elbows and the like of the player as shown by hatched parts of the player in FIG. 11. As shown in FIG. 10, the bone conduction microphones 121*a* to 121*i* are connected to a vibrational tone detecting circuit 122 which normally checks output levels of the bone conduction microphones 121*a* to 121*i*. This vibrational tone detecting circuit 122 outputs a discrimination signal for discriminating a certain bone conduction microphone the output level of which becomes larger than a predetermined level from the bone conduction microphones 121*a* to 121*i* and also outputs a vibrational tone detection signal (constituted by the analog signal or the digital signal) corresponding to the output level of the certain bone conduction microphone. These discrimination signal and the vibrational tone detection signal are supplied to a musical tone signal generating circuit 123 as the musical tone control data. Thus, the musical tone signal generating circuit 123 generates a musical tone signal having a tone pitch corresponding to the discrimination signal supplied from the vibrational tone detecting circuit 122, and the level of such musical tone signal is controlled by the vibrational tone detection signal. Such controlled musical tone signal is supplied to a speaker 124.

In the above-constructed fifth embodiment, the speaker 124 generates the musical tones having the tone pitches each corresponding to each of the bone conduction microphones 121*a* to 121*i* which is applied with the certain pressure, and the tone volume of such musical tone depends on the value of the vibrational tone detected by each of the bone conduction microphones 121*a* to 121*i* which is applied with the certain pressure.

Incidentally, it is possible to constitute the fifth embodiment such that the tone pitch or the tone color (or the tone color or the tone volume) of the musical tone is varied in response to the vibrational tone detection signal (or the discrimination signal). In addition, it is also possible to constitute the fifth embodiment such that the performance speed of the automatic rhythm tone is varied in response to the vibrational tone detection signal (or the discrimination signal). Further, if the bone conduction microphones 121*a* and 121*b* can be mounted at the player's wrists with ease, it is possible to modify the fifth embodiment such that the bone conduction microphones 121*a* and 121*b* are merely held by the player's hands.

As described heretofore, the switch on/off detecting circuit 104 directly outputs the detection results of the switch on/off states of the switches 101 as the musical tone control data, the pressure detecting circuit 114 directly outputs the detection results of the output levels of the amplifiers 113*a* to 113*e* as the musical tone control data, and the vibrational tone detecting circuit 122 directly outputs the detection results of the vibrational tones detected by the bone conduction microphones 121*a* to 121*i* as the musical tone control data. However, these third to fifth embodiments are not limited to such constitutions, and it is possible to modify these embodiments such that each detecting circuit can generate predetermined musical tone control data based on the detecting results thereof.

[F] SIXTH EMBODIMENT

Figure 12:
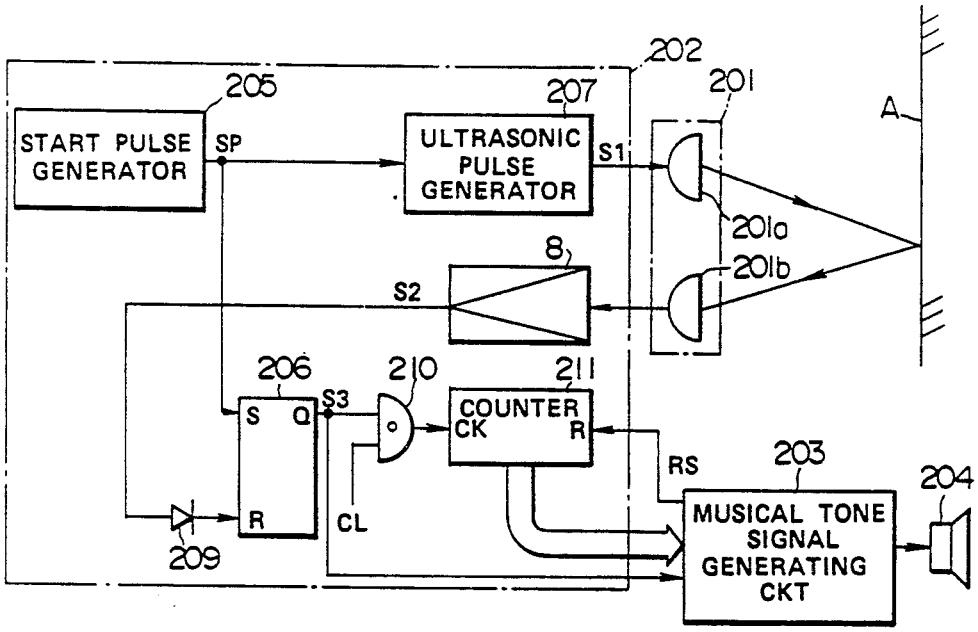
FIG. 12 is a block diagram showing a musical tone generating system employing the musical tone control apparatus according to a sixth embodiment.

Next, description will be given with respect to a sixth embodiment in conjunction with FIGS. 12 and 13. FIG. 12 is a block diagram showing a musical tone generating system employing the musical tone control apparatus according to the sixth embodiment of the present invention. This musical tone generating system shown in FIG. 12 is constituted by an ultrasonic transmitting-/receiving section 201, an ultrasonic measuring circuit 202, a musical tone signal generating circuit 203 and a speaker 204. This ultrasonic transmitting/receiving section 201 is mounted on a palm of the player's hand, and the ultrasonic measuring circuit 202, the musical tone signal generating circuit 203 and the speaker 204 are respectively mounted at the player's waist and his other portions. This ultrasonic transmitting/receiving section 201 is constituted by an ultrasonic transmitter 201*a* and an ultrasonic receiver 201*b* both formed by the piezoelectric element such as a barium titanate vibrator. The high frequency voltage is applied to the ultrasonic transmitter 201*a* so that the ultrasonic transmitter 201*a* generates an ultrasonic wave, and such ultrasonic wave is transmitted to the ultrasonic receiver 201*b* so that the ultrasonic receiver 201*b* generates the high frequency voltage. The ultrasonic measuring circuit 202 drives the ultrasonic transmitting/receiving section 201 so that a certain distance is measured by use of the ultrasonic wave.

Figure 13:
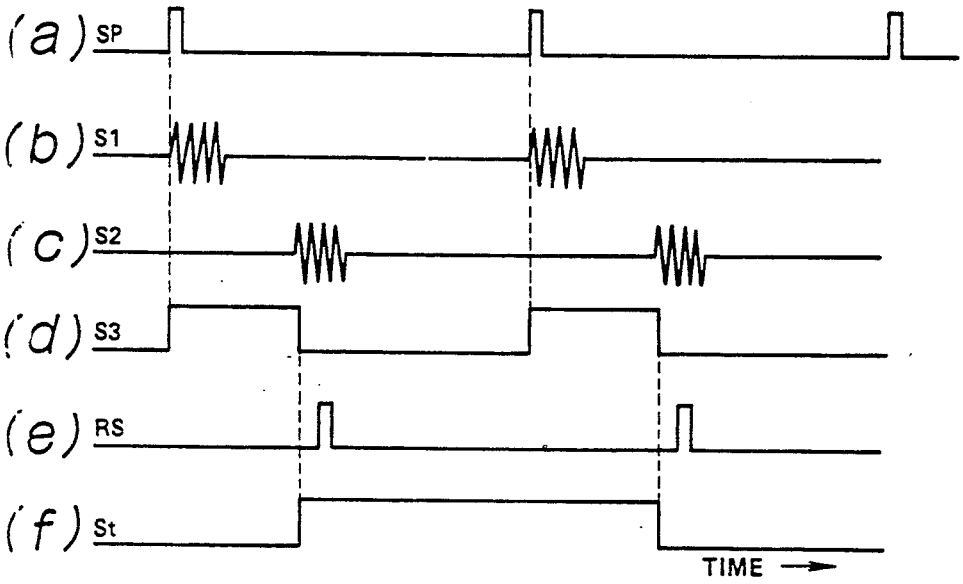
FIG. 13 shows waveforms of signals at several portions of the systems shown in FIGS. 12 and 14.

In the ultrasonic measuring circuit 202, a start pulse generator 205 generates and outputs a start pulse SP having a constant cycle (as shown in FIG. 13(*a*); In FIG. 13, a horizontal axis designates the time and a vertical axis designates the signal level) to a set input terminal S of a reset-set (RS) flip-flop 206 and an input terminal of an ultrasonic pulse generator 207. The ultrasonic pulse generator 207 is triggered by the start pulse SP so that the ultrasonic pulse generator 207 outputs an ultrasonic pulse S1 shown in FIG. 13(b)) to the ultrasonic transmitter 201*a*. Thus, the ultrasonic transmitter 201*a* transmits the ultrasonic wave to a wall (or a ceiling or a floor) A, and such ultrasonic wave is reflected by the wall A. The reflected ultrasonic wave is received by the ultrasonic receiver 201*b* so that the ultrasonic receiver 201*b* generates and outputs the high frequency voltage to an amplifier 208 wherein the high frequency voltage is amplified so as to obtain an amplified signal S2 (shown in FIG. 13(*c*)). The amplified signal S2 is rectified by a diode 209 and such rectified signal is supplied to a reset input terminal R of the RS flip-flop 206. This RS flip-flop 206 is set by the start pulse SP and reset by the output signal of the diode 209.

Therefore, the RS flip-flop 206 outputs a signal S3 (shown in FIG. 13(*d*)) from an output terminal Q thereof. This signal S3 has a pulse width the value of which corresponds to a distance between the ultrasonic transmitting/receiving section 201 and the wall A, in other words, a distance between the palm of the player's hand and the wall A. Such signal S3 is supplied to one input terminal of an AND gate 210 so that the AND gate 210 is subjected to an open state during a high-level period of the signal S3 and a clock pulse CL supplied to another input terminal of the AND gate 210 is supplied to a clock input terminal CK of a counter 211. Hence, the counter 211 counts up the clock pulse CL at every trailing edge timings of the signal S3 so that the counter 211 outputs a count value thereof. Thus, the count value of the counter 211 represents the distance between the palm of the player's hand and the wall A.

The above-mentioned count value of the counter 211 is supplied to a musical tone signal generating circuit 203. This musical tone signal generating circuit 203 inputs such count value of the counter 211 at the trailing edge timing of the signal S3, and slightly thereafter, the musical tone signal generating circuit 211 outputs a reset pulse RS (shown in FIG. 13(*e*)) to a reset input terminal R of the counter 211 to thereby reset the counter 211. Next, the musical tone signal generating circuit 203 generates a musical tone signal having a tone pitch corresponding to the inputted count value of the counter 211. This musical tone signal is supplied to the speaker 204, whereby the speaker 204 generates a musical tone having a tone pitch corresponding to the distance between the palm of the player's hand and the wall A.

As described heretofore, the sixth embodiment can generate the musical tone having the tone pitch corresponding to the relative position of the palm of the player's hand versus the wall A.

[G] SEVENTH EMBODIMENT

Figure 14:
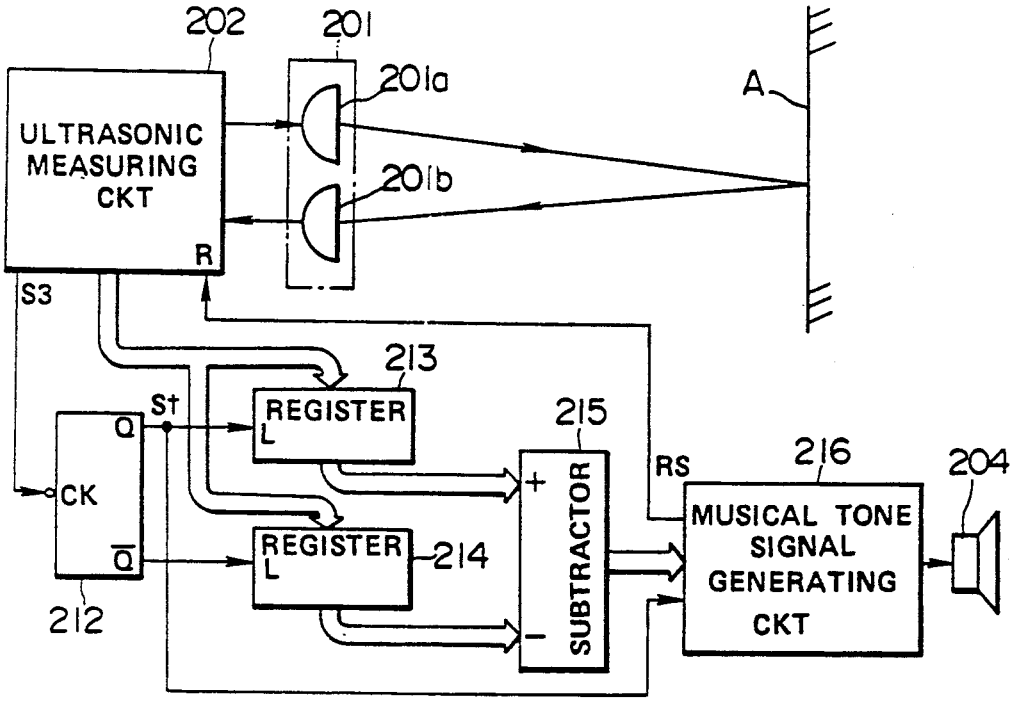
FIG. 14 is a block diagram showing a musical tone generating system employing the musical tone control apparatus according to a seventh embodiment.

Next, description will be given with respect to a seventh embodiment of the present invention in conjunction with FIGS. 13 and 14. FIG. 14 is a block diagram showing a musical tone generating system employing the musical tone control apparatus according to the seventh embodiment. This system shown in FIG. 14 employs the ultrasonic transmitting/receiving section 201, the ultrasonic measuring circuit 202 and the speaker 204 shown in FIG. 12, hence, detailed description thereof will be omitted.

In FIG. 14, a trigger (T) flip-flop 212 is triggered by the trailing edge of the signal S3 supplied to a clock input terminal Ck thereof from the ultrasonic measuring circuit 202, whereby the T flip-flop 212 outputs a signal St (shown in FIG. 13(*f*)) from an output terminal Q thereof to a load input terminal L of a register 213 and also outputs an inverted signal of the signal St from an output terminal $\overline{Q}$ thereof to a load input terminal L of a register 214. The register 213 inputs the count value of the counter 211 (shown in FIG. 12) within the ultrasonic measuring circuit 202 at a leading edge timing of the signal St. On the other hand, the register 214 inputs the count value of the counter 211 at a trailing edge timing of the signal St. Therefore, the registers 213 and 214 selectively store a result of a measured distance between the palm of the player's hand and the wall A in this seventh embodiment.

The respective data (representative of the measured distance between the palm of the player's hand and the wall A) stored in the registers 213 and 214 are supplied to a subtractor 215 wherein an output data value of the register 214 is subtracted from an output data value of the register 213. Thus, a subtraction result of the subtractor 215 (at the trailing edge timing of the signal St)

represents a distance variation between the palm of the player's hand and the wall A, in other words, a relative variation of the palm of the player's hand versus the wall A. Such subtraction result is outputted to a musical tone signal generating circuit 216. The musical tone signal generating circuit 216 outputs the reset signal RS to the counter 211 to thereby reset the counter 211 at a timing slightly after the leading edge timing and the trailing edge timing of the signal St. In addition, the musical tone signal generating circuit 216 inputs the output data of the subtractor 215 at the trailing edge timing of the signal St and generates a musical tone signal having a tone pitch corresponding to the inputted data thereof. Such musical tone signal is supplied to the speaker 204 so that the speaker 204 generates a musical tone having a tone pitch the value of which corresponds to the relative variation of the palm of the player's hand versus the wall A.

In the above-mentioned sixth and seventh embodiments, the tone pitch of the musical tone is varied in response to the position of the palm of the player's hand or the relative variation of the palm of the player's hand. Instead of the tone pitch, it is possible to vary the tone color or the tone volume of the musical tone in response to the position of the palm of the player's hand etc.

In the sixth and seventh embodiments, the start pulse SP is generated by every constant cycles. However, it is possible to modify the sixth and seventh embodiments such that the start pulse SP must be generated at a timing when the player pushes a push switch mounted on his hand.

In addition, the sixth and seventh embodiments detect the distance between the palm of the player's hand and a reference plane such as the wall A. Instead, it is possible to detect a relative distance between the player's right and left hands. More specifically, (instead of detecting the reflected ultrasonic (wave) the ultrasonic receiver 201*b* mounted on the player's left hand can detect the direct ultrasonic wave transmitted from the ultrasonic transmitter 201*a* mounted on the player's right hand, for example. Further, it is possible to mount one of the ultrasonic transmitter 201*a* and the ultrasonic receiver 201*b* on the player's hand and also fix the other at an arbitrarily selected position (such as a certain position on the wall). Furthermore, the positions at which the ultrasonic transmitter 201*a* and the ultrasonic receiver 201*b* are mounted are not limited to the hands of the player (or an animal), and it is possible to mount them on other positions such as a foot, a waist or a head of the player (or the animal).

According to all embodiments described heretofore, it is possible to convert the body action of the player into the musical tone, hence, the present invention can obtain several effects in a field of rhythm gymnastics and the like.

This invention may be practiced or embodied in still other ways without departing from the spirit or essential character thereof. Accordingly, the preferred embodiments described herein are therefore illustrative and not restrictive, the scope of the invention being indicated by the appended claims and all variations which come within the meaning of the claims are intended to be embraced therein.

What is claimed is:

1. A musical tone control apparatus comprising:

(a) detecting means for detecting position on a player to which a certain pressure is given by touching or beating movement, wherein said detecting means includes a plurality of touch switches which are mounted at several portions of the player and activated when a predetermined pressure is given thereto, said touch switches being electrically arranged in a matrix, and means for scanning said switches at a predetermined cycle so that a coordinate of a touch switch to which the predetermined pressure is applied is detected; and (b) means for generating musical tone control data based on a detecting result of said detecting means, said musical tone control data controlling a musical tone signal.

2. A musical tone control apparatus comprising:

(a) detecting means for detecting a value of a pressure given to a certain portion of a player by his touching or beating movement, wherein said detecting means includes a plurality of conductive rubber portions each having a resistance which varies in response to a pressure given thereto, said detecting means detecting the value of the pressure given to said conductive rubber portion based on a resistance variation of said conductive rubber portion; and (b) means for generating musical tone control data based on a detecting result of said detecting means, said musical tone control data controlling a musical tone signal.

3. A musical tone control apparatus comprising:

(a) detecting means for detecting a vibrational tone generated from a player by his touching or beating movement wherein said detecting means includes a plurality of bone conduction microphones each picking up vibration, said bone-conduction microphones being mounted at predetermined portions of the player adjacent to bones of the player's body; and (b) means for generating musical tone control data based on a detecting result of said detecting means, said musical tone control data controlling a musical tone signal.

* * * * *